US008661616B1

(12) United States Patent
Luca

(10) Patent No.: US 8,661,616 B1
(45) Date of Patent: Mar. 4, 2014

(54) DOOR CLOSER WITH PUSH BUTTON HOLD OPEN MECHANISM

(75) Inventor: Valentin Luca, Fairfield, CT (US)

(73) Assignee: Connecticut Manufacturing Co., S.A., Bacau (RO)

( * ) Notice: Subject to any disclaimer, the term of this patent is extended or adjusted under 35 U.S.C. 154(b) by 0 days.

(21) Appl. No.: 13/184,629

(22) Filed: Jul. 18, 2011

(51) Int. Cl.
*E05F 3/02* (2006.01)
*E05C 17/02* (2006.01)

(52) U.S. Cl.
USPC ..... 16/66; 16/70; 292/305; 292/306

(58) Field of Classification Search
USPC ..... 16/66, 70, 62, 49, 63, 65; 292/306, 262, 292/278, 266, 267, 268, 305
See application file for complete search history.

(56) References Cited

U.S. PATENT DOCUMENTS 3,710,417 A * 1/1973 Berman et al. ..... 16/296
5,630,248 A * 5/1997 Luca ..... 16/71
5,832,562 A * 11/1998 Luca ..... 16/71
7,134,168 B1 * 11/2006 Qing ..... 16/80
7,216,400 B2 * 5/2007 Hodson ..... 16/66
8,051,534 B1 * 11/2011 Luca ..... 16/66

* cited by examiner

*Primary Examiner* — Emily Morgan
(74) *Attorney, Agent, or Firm* — Fattibene and Fattibene LLC; Paul A. Fattibene

(57) ABSTRACT

A pneumatic door closer having an arming and latching mechanism that once armed permits a door to be held open by placing it in the desired open position and easily released by opening the door slightly, resetting the arming and latching mechanism permitting the door to be closed. A lever having a flat-profile spring over a substantial portion of its exterior surface is rotated into a position adjacent a latching washer causing the latching washer to canter upon a slight closure of the door, locking the door in an open position. Upon release of the door by further opening the door slightly, the cantered latching washer is released and a recoil spring causes the released latching washer to straighten or become uncantered, permitting a piston rod to move freely relative to the latching mechanism causing the door to close. The single piece lever and external flat-profile spring are easily manufactured and assembled and provides a reliable latching mechanism that can be conveniently operated with one hand.

11 Claims, 5 Drawing Sheets

DOOR CLOSER WITH PUSH BUTTON HOLD OPEN MECHANISM

FIELD OF THE INVENTION

The present invention relates in general to a pneumatic door closer and more specifically to a door closer having an arming or latching mechanism to automatically hold a door open and to permit its easy closure.

BACKGROUND OF THE INVENTION

Pneumatic door closers have been known for many years. Generally, a pneumatic door closer is used to permit a door to be opened and then to gradually shut without slamming. Often it is desired for a door to be held open, permitting a person to come in and out more easily. This has often been done with a washer placed on a rod that is manually moved or slid along the rod to a position adjacent a pneumatic cylinder for locking on a rod and holding the door open. This often requires the use of two hands, one for holding the door open and the other for moving or sliding the washer to a position adjacent the pneumatic cylinder of the door closer. Also, to close the door, two hands are often needed; one for holding the door open and the other for moving or sliding the washer away from the pneumatic cylinder and into a home position permitting the door to close. This has proven to be very inconvenient because often a person is carrying something in one hand and does not have the two hands required for holding the door in an open position. Efforts have been made to develop a different more convenient door closer that is easier to hold open and close without the need for two free hands.

One such device that has worked well and has achieved wide-spread acceptance is a door closer disclosed in U.S. Pat. No. 5,832,562 issued to Luca on Nov. 10, 1998 and entitled "Door Closer", which is herein incorporated by reference. Therein disclosed, in one embodiment, is an arming or latching mechanism having an internal coiled spring and a trigger used to automatically hold a door open. While the arming or latching mechanism disclosed therein has worked well, it is comprised of multiple parts that require manufacture and assembly and therefore has a higher cost.

Accordingly, there is a need to continuously improve door closers, and particularly for providing a hold-open mechanism that is less expensive to manufacture.

SUMMARY OF THE INVENTION

The present invention provides an improved door closer having an arming or latching mechanism for holding a door open and yet permits its easy release and closure. A lever, having a flat-profile spring, made of sheet or wire type of material, the flat-profile spring circumscribing a substantial portion of its perimeter is used to contact a latching washer slidably placed on a piston rod, moving it into a canted position for holding a door in an open position. The flat-profile spring has a dampening or trigger end contacting the latching washer and a friction portion end holding the lever in an armed or a set position. In the armed or set position the dampening or trigger end portion of the flat-profile spring touches the latching washer causing the latching washer to cant relative to the piston rod as the door begins to close, locking the door in an open position. When the canted latching washer contacts the lever, it pushes the lever back into a reset position so that after being locked, when the door is moved open slightly a recoil spring placed around the piston rod pushes the latching washer flat or uncanted, permitting the piston rod to move and the door to close.

Accordingly, it is an object of the present invention to provide a door closer that can be locked in an open position by a simple push on a button.

It is another object of the present invention to provide a door closer that can release the door for closing by only a slight push open on the door.

It is an advantage of the present invention that it is easily manufactured and assembled.

It is another advantage of the present invention that fewer parts are utilizing, making a more cost efficient latching mechanism.

It is a feature of the present invention that a flat-curved or flat profile-spring is used.

It is another feature of the present invention that a shaped single piece lever is used.

These and other objects, advantages, and features will become more readily apparent in view of the following more detailed description.

DETAILED DESCRIPTION OF THE PREFERRED EMBODIMENT

Figure 1:
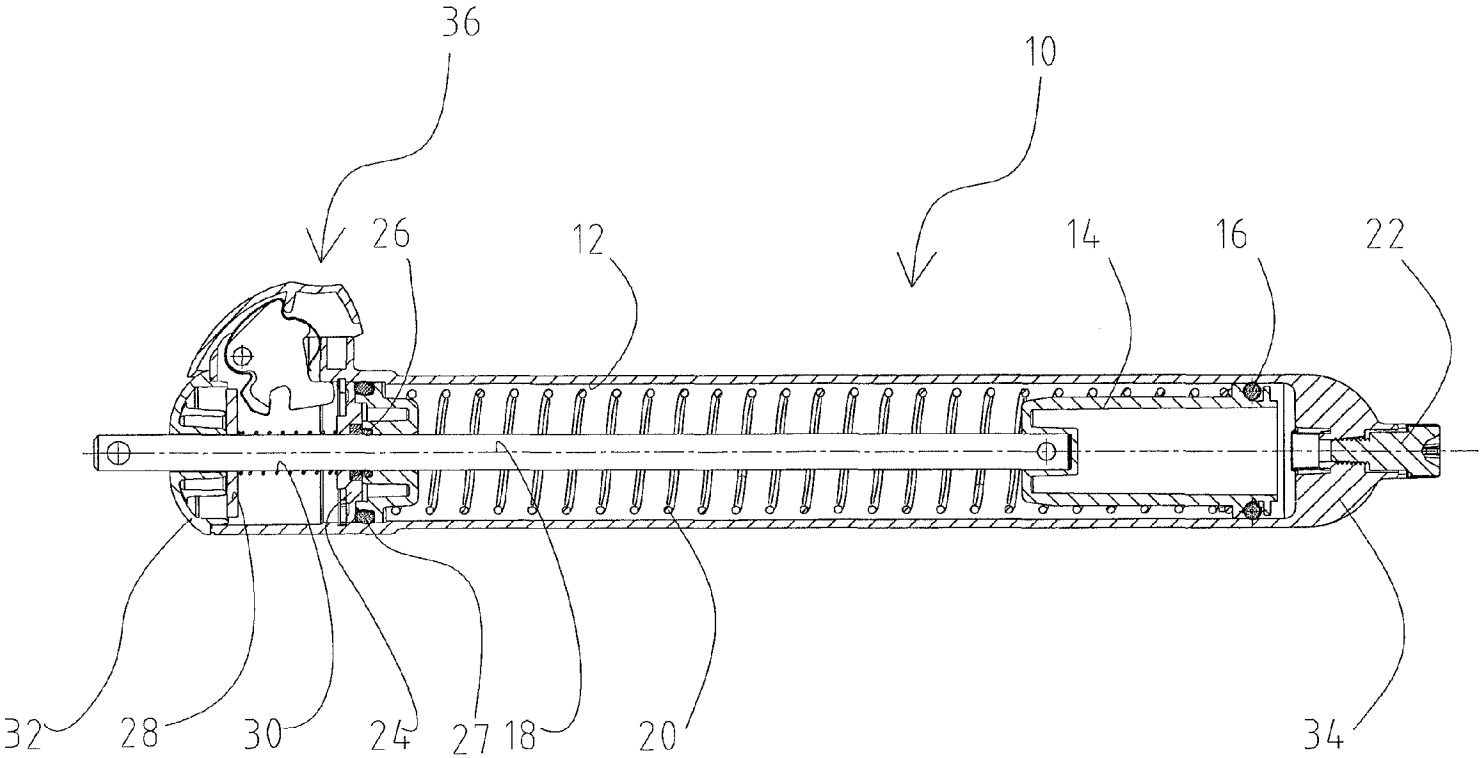
FIG. 1 is a cross section elevational view of the door closer of the present invention.

FIG. 1 is a cross-section elevational view illustrating the pneumatic door closer 10 of the present invention. The pneumatic door closer 10 has an elongated cylinder 12 with a piston 14 therein. The piston 14 has a piston seal 16. Piston seal 16 preferably acts as a valve permitting passage of air in one direction as is common in piston seals used in pneumatic door closers. The piston 14 may be of a size so as to modify a predetermined volume within the cylinder 12. Accordingly, the volume modifying piston 14 can be adjusted in size to modify a predetermined volume within either the pressure side or the vacuum side of the cylinder 12. The predetermined volume can be adjusted to modify the pressure side or vacuumed side volume of the piston 14 so as to control the door closing characteristics and can be used to balance door closing forces. Connected to the piston 14 is a piston rod 18. Within the cylinder 12 is a compression spring 20 circumscribing the piston rod 18. At closed end 34 of the cylinder 12 is a metering valve 22. The metering valve 22 may be a screw or needle valve that can be adjusted to control the air permitted to escape the pressure side on one side of the piston 12. An end wall 32 is formed on the other end of the cylinder 12 opposing the closed end 34. Piston rod 18 extends through the end wall 32. Intermediate the end wall 32 and the closed end 34 is a partition wall 24. Placed in the space between the partition wall 24 and the end wall 32 is an arming or latching mechanism 36. Within this space between the partition wall 24 and the end wall 32 is a latching washer 28 and recoil spring 30. Recoil spring 30 is a helical spring placed around a portion of the longitudinal length of the piston rod 18. The recoil spring 30 has one end adjacent the petition wall 24 and the other end adjacent the latching washer 28. The particular pneumatic cylinder embodiment shown in FIG. 1 has sealing means that creates vacuum on the spring side of the piston. The sealing means are the rod seal 26 placed within the partition wall 24 for sealing around the piston rod 18 and the partition wall cylinder seal 27 that seals the partition wall to the cylinder.

Figure 2A:
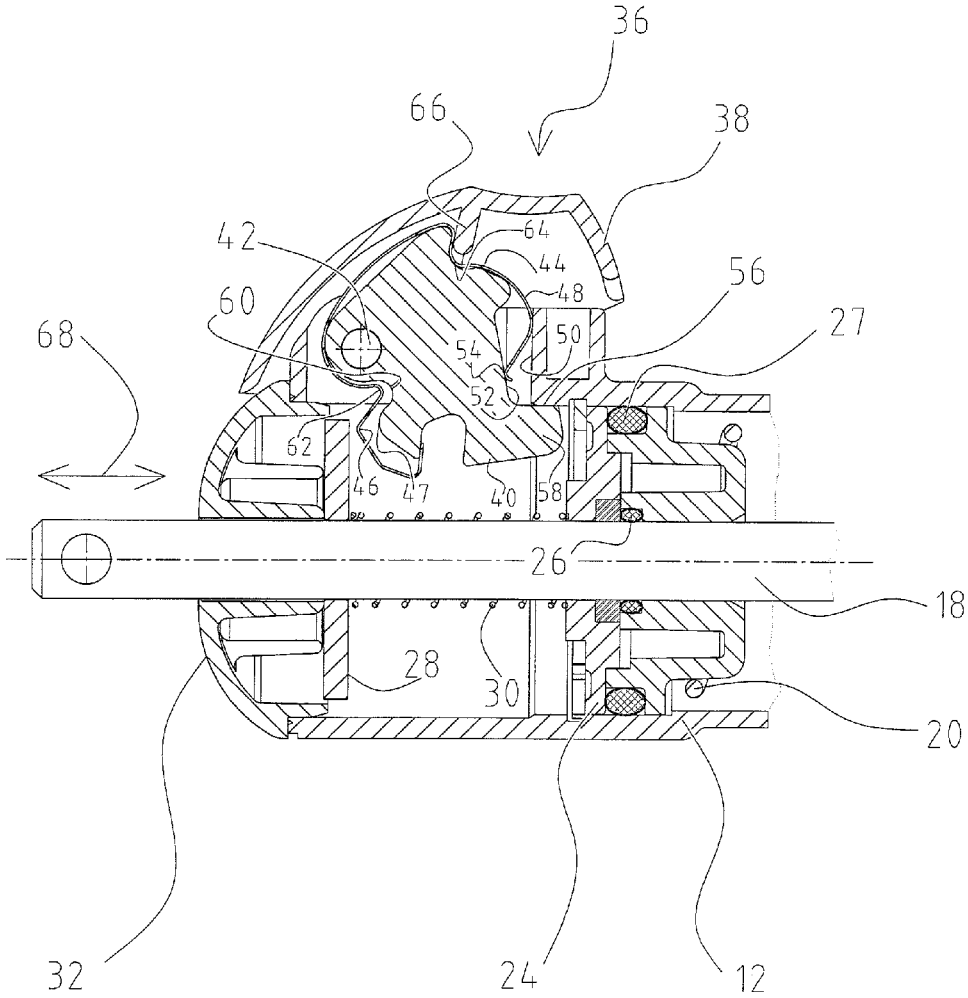
FIG. 2A is an enlarged partial cross section view of the arming or latching mechanism illustrated in FIG. 1 in an unarmed state.

FIG. 2A is an enlarged view illustrating the arming or latching mechanism 36. In FIG. 2A the arming or latching mechanism 36 and latching washer 28 are in an unarmed position permitting the piston rod 18 to move freely relative to the latching mechanism 36 in both directions, as illustrated by arrow 68. The arming or latching mechanism 36 comprises a cap 38, serving as a push button, placed over a lever 40 that pivots on pivot 42. Circumscribing a substantial portion of the external circumference or perimeter of lever 40 is a flat-profile spring 44. The flat-profile spring 44, on one end has a trigger end 46 and on the other or opposing end has a friction portion 48. Adjacent the trigger end 46 of the flat-profile spring 44 is a trigger end spring support 47 formed on the lever 40. The friction portion 48 is configured to contact, ride, or cam on surface 50. A spring friction end 54, on the flat-profile spring 44, rides on surface 52. Stop surface 56 in combination with stop 58 prevents the lever 40 from rotating too far in a counter-clockwise direction about pivot 42. The perimeter or exterior surface of the lever 40 and the shape of the flat-profile spring 44 may take any convenient form. For example only, formed within the lever 40 is a lever spring recess 60 adapted to receive a spring bend 62. Also formed within the lever 40 is a lever cap recess 64. The cap 38 is provided with a cap extension 66 that helps to retain the flat-profile spring 44 within or adjacent the lever cap recess 64. These features aid in retaining the flat spring 44 on the exterior outer surface of the lever 40. The flat-profile spring 44 may be made of sheet, strip, or wire made of spring steel. The structure of a single piece lever 40 and a flat-profile spring 44 being placed on the shaped exterior surface of the lever 40 results in easy assembly.

Figure 2B:
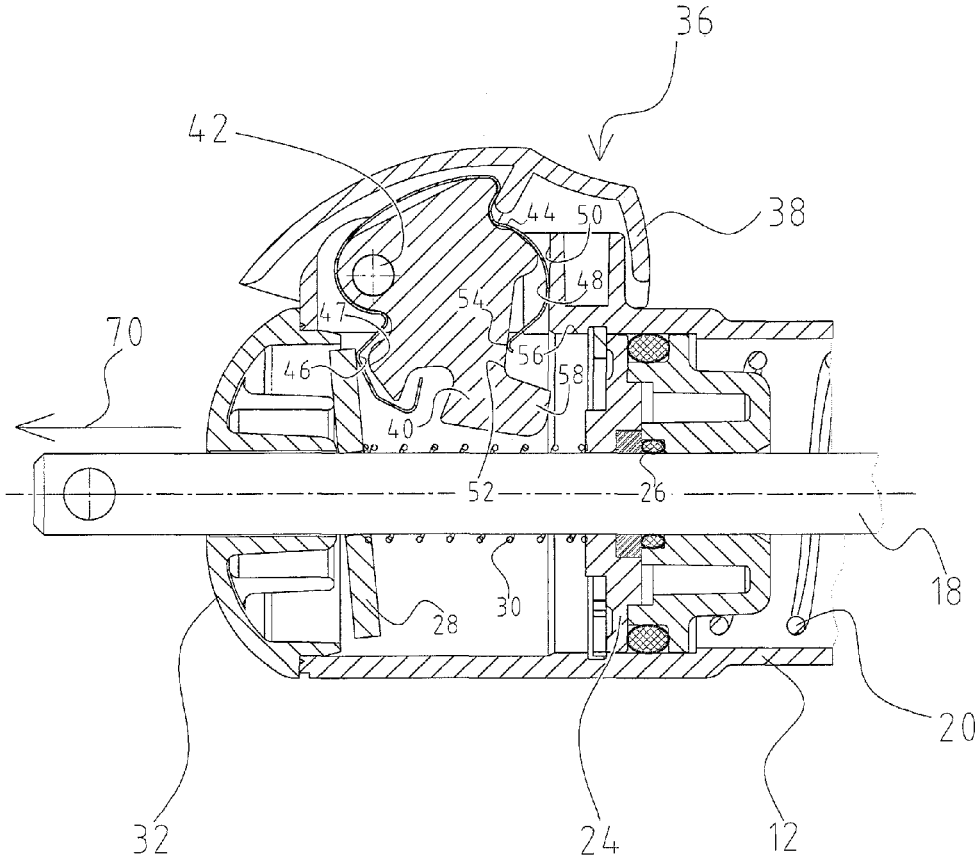
FIG. 2B is a partial cross section view of the arming or latching mechanism illustrated in FIG. 1 in an armed state.

FIG. 2B illustrates the arming or latching mechanism 36 with the cap 38 pushed downward so that the lever 40 rotates clockwise about pivot 42 such that the lever 40 and the trigger end 46 and adjacent trigger end spring support 47 are placed very near or contact the latching washer 28. With the arming or latching mechanism 36 in the armed position, the piston rod 18 is permitted to move in the direction indicated by arrow 70 permitting the piston rod 18 to be extended and the door to be opened. When the door is in a sufficiently opened position and then released, the armed arming and latching mechanism 36 will prevent the piston rod 18 from retracting into the cylinder 12 holding the door open.

Figure 2C:
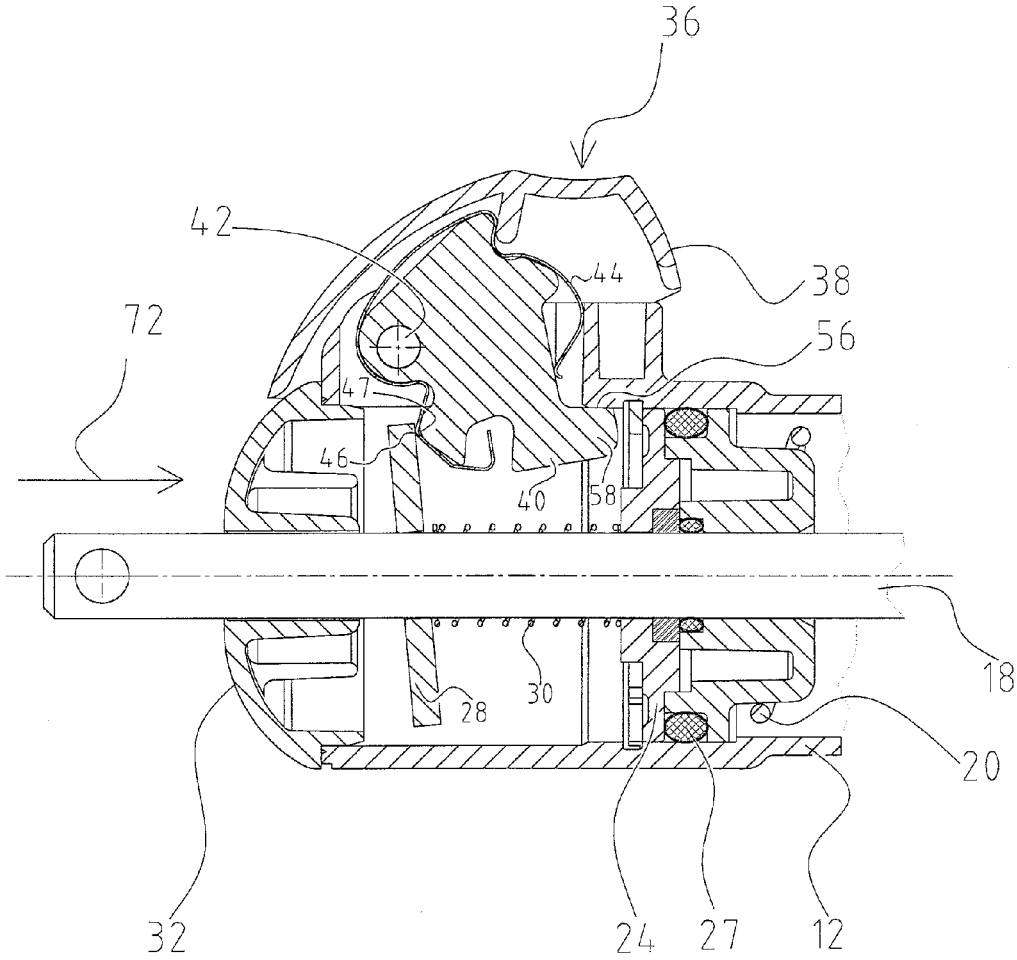
FIG. 2C is a partial cross sectional view of the arming or latching mechanism in a state holding a door open.

FIG. 2C illustrates the operation of the arming and latching mechanism 36 so as to hold a door open and preventing its closing when the piston rod 18 is pulled in the direction indicated by arrow 72. As illustrated in FIG. 2C, upon the movement of the piston rod 18 in the direction indicated by arrow 72 in which the door is slightly closed, the latching washer 28 contacts the trigger end 46 of the flat-profile spring 44 and the trigger end spring support on lever 40 causing the latching washer 28 to rotate counter clockwise and cant, and also to rotate the lever 40 counter-clockwise, forcing the stop 58 adjacent the stop surface 56. The door is held in an open position due to the force provided by the compression spring 20 pushing the piston rod 18 in the direction of the arrow 72 keeping the latching washer cantered, gripping the piston rod 18 and preventing its movement. In order to close the door after being held opened, the door may be pushed slightly more open so that the piston rod 18 moves in a direction opposite to that of arrow 72, illustrated in FIG. 2C. This causes the pressure exerted on the latching washer 28 by the trigger end 46 and trigger end spring support 47 formed on lever 40 to be released, freeing the latching washer 28 resulting in it becoming uncanted, and the recoil spring 30 forcing the latching washer 28 back towards the end wall 32. Accordingly, the arming and latching mechanism 36 is now reset and placed in a position as illustrated in FIG. 2A in which the piston rod 18 is free to move in either direction relative to the arming and latching mechanism 36, as illustrated by arrow 68 in FIG. 2A.

Figure 3:
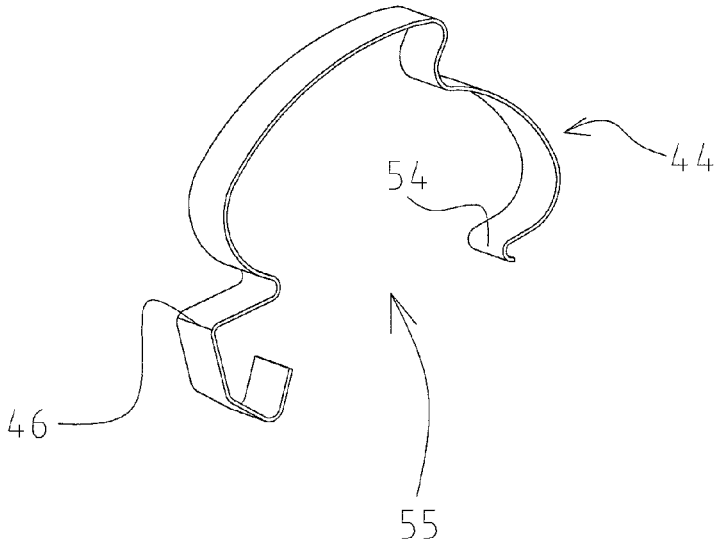
FIG. 3 is a perspective view of the flat-profile spring made from sheet material.

FIG. 3 is a perspective view of the flat-profile spring 44. The flat-profile spring 44 has a general horse shoe shape having an opening 55 and is placed over the lever 40, not shown in FIG. 3, and circumscribes a portion of the perimeter of the exterior perimeter of the lever 40. One end of the flat-profile spring 44 forms the spring friction end 54 and the other end forms the trigger portion 46 of the flat-profile spring 44. The flat-profile spring opening 55 has a width narrower than a width of the lever 40. This permits the flat-profile spring 44 to be expanded to be placed over the exterior perimeter of the lever 40 and snap into place and held secularly on the lever 44. This facilitates assembly of the latching mechanism 36, illustrated in FIGS. 1 and 2A-C.

Figure 4:
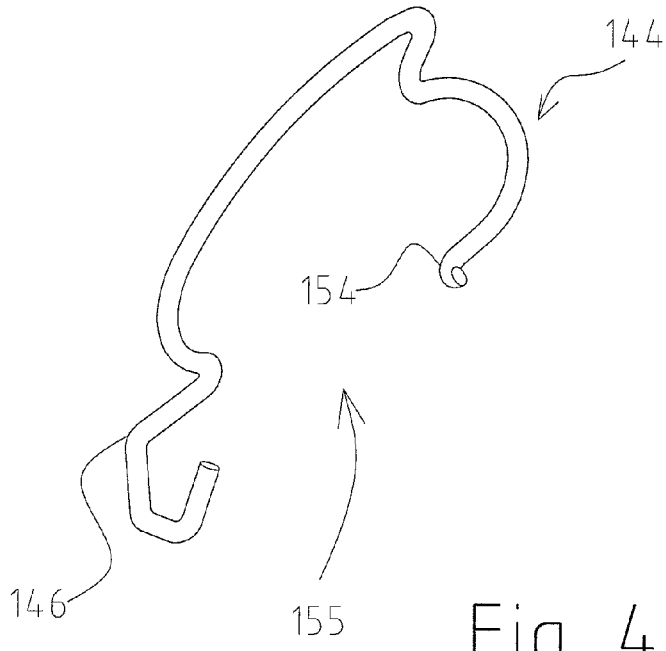
FIG. 4 is a perspective view of the flat-profile spring made from wire.

FIG. 4 illustrates another embodiment of a flat-profile spring 144. In this embodiment the flat-profile spring 144 is made of wire. The flat-profile spring 144 has a general horse shoe shape having an opening 155 and is placed over the lever 40, not shown in FIG. 4, and circumscribes a portion of the perimeter of the exterior perimeter of the lever 40. One end of the flat-profile spring 144 forms the spring friction end 154 and the other end forms the trigger portion 146 of the flat-profile spring 144.

While the present invention has an arming and latching mechanism that operates similarly to that disclosed in U.S. Pat. No. 5,832,562, the present invention provides substantial improvements that permit easier manufacturing. The present invention, in utilizing a single-piece lever in combination with a shaped flat-profile spring circumscribing a substantial portion of the lever, makes possible easy assembly with reliable operation.

While the present invention has been described with respect to a preferred embodiment, it will be obvious that various modifications may be made without departing from the spirit and scope of this invention.

What is claimed is:

1. A door closer comprising:

an elongated cylinder forming a piston chamber, a piston reciprocally mounted within the piston chamber;

a piston rod connected to said piston;

a compression spring placed within the piston chamber;

a latching washer placed on said piston rod;

a lever placed adjacent said latching washer whereby said lever can be rotated into an armed position adjacent to said latching washer;

a flat-profile spring extending around a substantial portion of the exterior surface of said lever, said flat-profile spring having a trigger end contacting said latching washer when in an armed position;

a friction portion of said flat-profile spring contacting a surface stationary relative to said elongated cylinder, whereby said friction portion holds said flat-profile spring in the armed position; and a recoil spring placed around said piston rod and biasing said latching washer toward an end wall of said elongated cylinder, whereby once said door closer is armed said piston rod may be held in a position and easily released.

2. A door closer as in claim 1 further comprising:

a stop formed on said lever adapted to contact a stop surface.

3. A door closer as in claim 1 further comprising:

a trigger end spring support formed on said lever adjacent the trigger end of said flat-profile spring.

4. A door closer having a latching mechanism that once armed can automatically hold a door in an open position and permit easy release and closing comprising:

an elongated cylinder having an end wall and opposing closed end forming a piston chamber;

a piston reciprocally mounted within the piston chamber;

a partition wall formed intermediate the end wall and the opposing closed end of the piston chamber;

a piston rod having one end connected to said piston and another end extending through said partition wall and out of the end wall;

a compression spring placed within the piston chamber between the partition wall and said piston biasing said piston adjacent the closed end and the door to a closed position;

a latching washer having a hole with said piston rod extending through the hole;

a lever placed between the end wall and said partition wall and adjacent said latching washing whereby said lever can be rotated into an armed position adjacent to said latching washer;

a flat-profile spring extending around a substantial portion of the exterior surface of said lever, said flat-profile spring having a trigger end contacting said latching washer when in an armed position;

a cap covering and contacting said lever, whereby movement of said cap places said lever in the armed position;

a friction portion of said flat-profile spring contacting a surface stationary relative to said elongated cylinder, whereby said friction portion holds said flat-profile spring in the armed position; and a recoil spring placed around said piston rod between said latching washer and said partition wall and biasing said latching washer toward the end wall of said elongated cylinder, whereby once said latching mechanism is armed said piston rod may be held in a position and easily released.

5. A door closer having a latching mechanism as in claim 4 further comprising:

a rod seal placed in said partition wall, whereby said piston rod passes there through.

6. A door closer having a latching mechanism as in claim 5 wherein:

said piston displaces a predetermined volume within said cylinder, whereby when said piston moves and a vacuum is formed on a vacuum side of said piston the predetermined volume between a pressure side and the vacuum side of said piston can be adjusted to modify a closing force.

7. A door closer having a latching mechanism as in claim 4 further comprising:

a metering valve formed in the closed end.

8. A door closer having a latching mechanism comprising:

an elongated cylinder having an end wall and opposing closed end forming a piston chamber;

a volume modifying piston reciprocally mounted within the piston chamber, said volume modifying piston having a predetermined volume to selectively modify the volume of the piston chamber whereby the closing force can be balanced between a pressure side and a vacuum side of said volume modifying piston;

a partition wall formed intermediate the end wall and the opposing closed end of the piston chamber;

a cylinder seal placed between said partition wall and said elongated cylinder;

a rod seal in said partition wall;

a piston rod having one end connected to said volume modifying piston and another end extending through said partition wall rod seal in said partition wall and out of the end wall;

a compression spring placed within the piston chamber between the partition wall and said piston, biasing said piston adjacent the closed end and the door to a closed position;

a latching washer having a hole with said piston rod extending through the hole;

a lever having an exterior perimeter and placed between the end wall and said partition wall and adjacent said latching washer whereby said lever can be rotated into an armed position adjacent to said latching washer;

a flat-profile spring extending around a substantial portion of the exterior perimeter of said lever, said flat-profile spring having a trigger end contacting said latching washer when in an armed position and a friction portion opposite the trigger end contacting a surface stationary relative to said elongated cylinder, whereby the friction portion holds said lever in the armed position;

a cap covering and contacting said lever, whereby movement of said cap places said lever in the armed position; and a recoil spring placed around said piston rod between said latching washer and said partition wall and biasing said latching washer toward the end wall of said cylinder, whereby once said latching mechanism is armed said piston rod may be held in a position and easily released.

9. A door closer having a latching mechanism as in claim 8 wherein:

said flat-profile spring comprises a sheet material.

10. A door closer having a latching mechanism as in claim 8 wherein:

said flat-profile spring comprises a wire.

11. A door closer comprising:

an elongated cylinder forming a piston chamber having a volume, a piston reciprocally mounted within the piston chamber for changing the volume of said piston chamber to a predetermined volume selected to modify closing forces of said door closer;

a piston rod connected to said piston;

a compression spring placed within the piston chamber;

a latching washer placed on said piston rod;

a lever placed adjacent said latching washer whereby said lever can be rotated into an armed position adjacent to said latching washer;

a flat-profile spring extending around a portion of the exterior surface of said lever, said flat-profile spring having a trigger end contacting said latching washer when in an armed position;

a friction portion of said flat-profile spring contacting a surface stationary relative to said elongated cylinder, whereby said friction portion holds said flat-profile spring in the armed position; and a recoil spring placed around said piston rod and biasing said latching washer toward an end wall of said cylinder, whereby once said door closer is armed said piston rod may be held open and easily released.

* * * * *